US005103898A

United States Patent [19]

Krimsky

[11] Patent Number: 5,103,898

[45] Date of Patent: Apr. 14, 1992

[54] COOLED VACUUM PULL ROLL

[75] Inventor: Leonard C. Krimsky, Englewood, N.J.

[73] Assignee: Worldwide Converting Machinery, Allendale, N.J.

[21] Appl. No.: 551,193

[22] Filed: Jul. 11, 1990

[51] Int. Cl.[5] ..... F28D 11/02

[52] U.S. Cl. ..... 165/89; 34/124; 226/95

[58] Field of Search ..... 165/89; 34/122, 124; 226/95

[56] References Cited

U.S. PATENT DOCUMENTS

| | | | |
|---|---|---|---|
| 1,215,236 | 2/1917 | Badenhausen | 34/122 |
| 2,299,662 | 10/1942 | Thaler | 34/122 |
| 3,080,150 | 3/1963 | Gross | 165/76 |
| 3,752,227 | 8/1973 | Bulson | 165/89 |
| 4,207,998 | 6/1980 | Schmid | 226/95 |

FOREIGN PATENT DOCUMENTS

| | | | |
|---|---|---|---|
| 376127 | 7/1990 | European Pat. Off. | 226/95 |
| 2000436 | 7/1971 | Fed. Rep. of Germany | 226/95 |

*Primary Examiner*—Allen J. Flanigan
*Attorney, Agent, or Firm*—Shenier & O'Connor

[57] ABSTRACT

A pull roll in which the outer shell of a cooling roll through which a cooling medium flows has grooves in its outer surface forming lands which support a perforated skin. Communication is provided between the shell grooves and a segmented stator groove connected to a source of reduced pressure so that the vacuum exerts a pull on the web while the cooling medium cools the web through the skin.

8 Claims, 2 Drawing Sheets

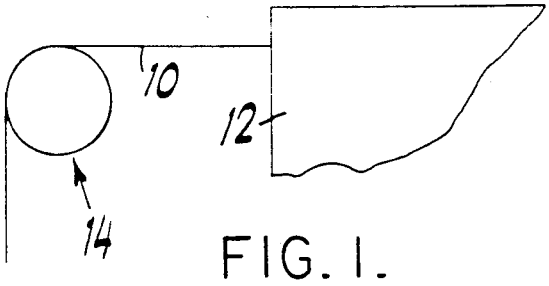
FIG. 1.
FIG. 3.
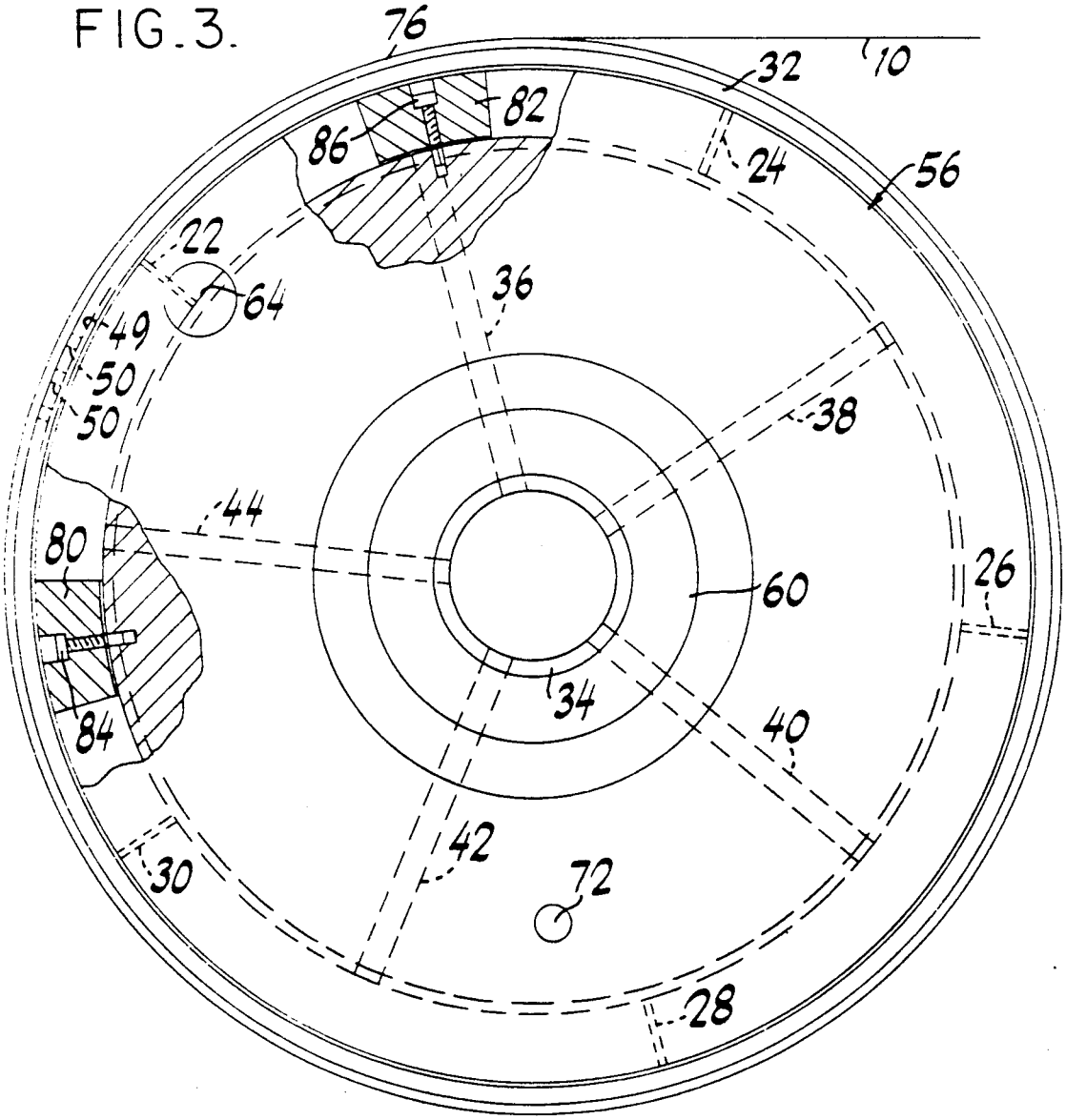

COOLED VACUUM PULL ROLL

FIELD OF THE INVENTION

The invention is in the field of converting machinery and, more particularly, it relates to an improved roll for pulling a web out of a processing station.

BACKGROUND OF THE INVENTION

In the prior art of converting machinery, pull rolls are employed to draw the web out of a processing station. Where the station is a dryer, the pull roll is cooled so as to perform the dual function of pulling the web out of the processing station while at the same time cooling the web. It will be appreciated that in order to generate the required pull, the web must wrap around the roll for an appreciable portion of the circumference thereof.

When dealing with an adhesive coated web or a web with a very delicate surface coating which would be marred by wrapping around a cooling roll, not enough pull is generated from just a single roll contacting the back side of the web. In this circumstance, a vacuum pull roll is employed. Rolls of this type which are known in the prior art have a perforated surface through which a vacuum is drawn. This vacuum is usually limited to the region of the roll which is contacted by the web. However, when using such a vacuum pull roll in connection with a dryer, some other means must be provided to cool the coated web before it goes into a laminator, for example, in which it is laminated to a second web at room temperature since an attempt to combine the hot web with a cold web results in an inferior product.

SUMMARY OF THE INVENTION

One object of my invention is to provide a cooled vacuum pull roll which overcomes the difficulties in the prior art of handling hot adhesive coated webs and the like.

Another object of my invention is to provide a pull roll which combines the function of a vacuum pull roll with a cooling roll.

Another object of my invention is to provide a cooled vacuum pull roll which is simple in construction and operation for the results achieved thereby.

Other and further objects of my invention will appear from the following description.

BRIEF DESCRIPTION OF THE DRAWINGS

In the accompanying drawings to which reference is made in the instant specification and which are to be read in conjunction therewith and in which like reference numerals are used to indicate like parts in the various views:

FIG. 1 is a diagrammatic view illustrating the relationship of my cooled vacuum pull roll to a web emerging from a processing station.

FIG. 3 is an end elevation of the form of my cooled vacuum pull roll shown in FIG. 2, with parts broken away and other parts shown in section.

DESCRIPTION OF THE PREFERRED EMBODIMENT

Figure 2:
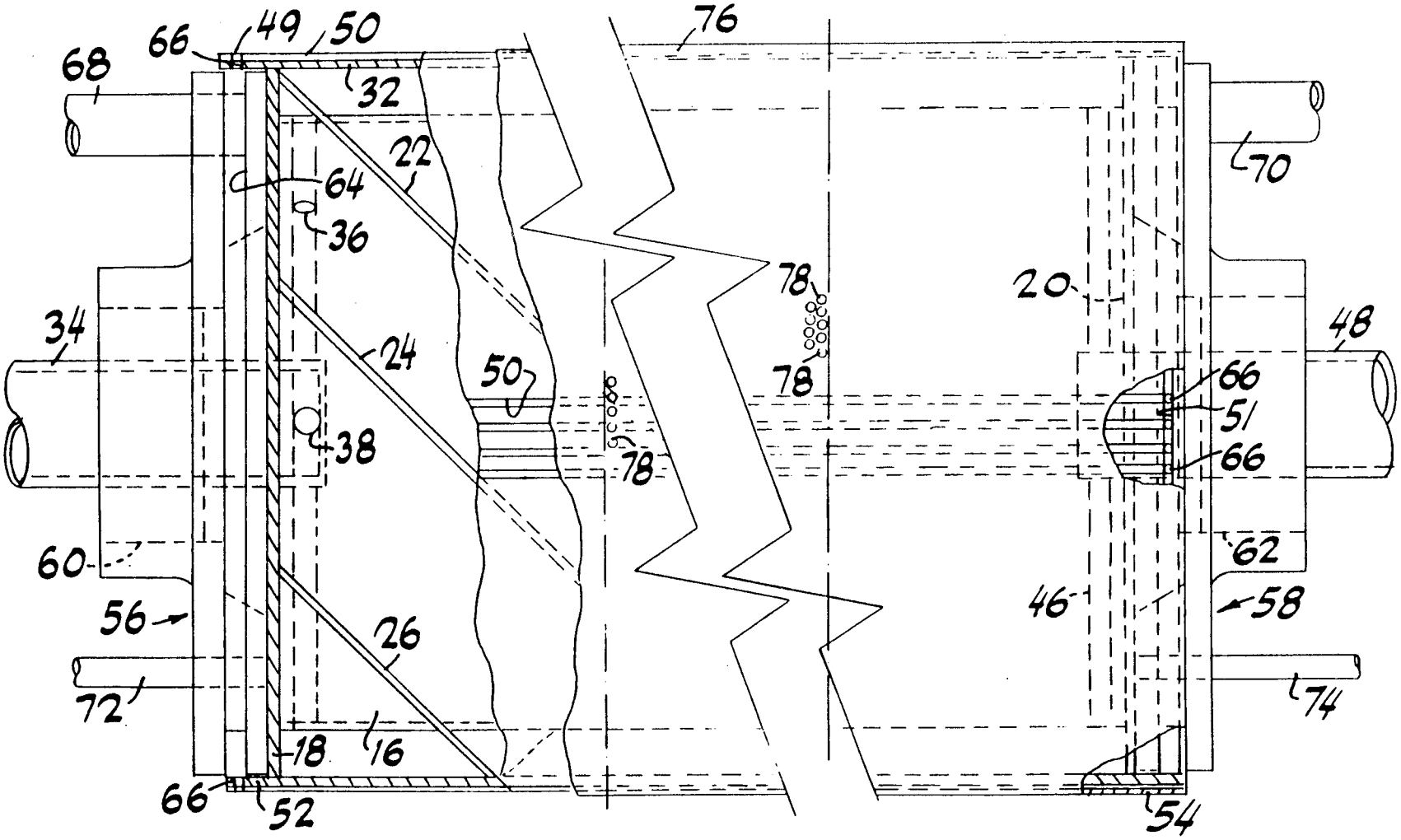
FIG. 2 is a side elevation of my cooled vacuum pull roll with parts broken away and with other parts shown in section.

Referring now to the drawings, a web 10 emerging from a process station 12 is adapted to be withdrawn therefrom by my cooled vauum pull roll indicated generally by the reference character 14. The roll 14 includes a hollow inner drum shell 16 provided with respective end plates 18 and 20 having a diameter greater than the outside diameter of the shell 16. A plurality of spiral ribs, such for example as five ribs 22, 24, 26, 28, and 30 are applied to the outer surface of the drum 16 between the end plates 18 and 20 in any suitable manner known to the art, such for example as by welding or the like. The ribs 22, 24, 26, 28 and 30 and the end plates 18 and 20 receive an outer shell 32, the ends of which extend for a short distance beyond the end plaes 18 and 20.

A hollow shaft 34 carried by the end plate 18 extends for a short distance inside the shell 16 and is terminated at that point. A plurality of supply pipes 36, 38, 40, 42 and 44 lead from the interior of the hollow shaft 34 to the respective spaces between adjacent spiral ribs.

End plate 20 carries a second hollow shaft 48 extending inwardly of the plate 20 for a short distance inside the shell 16. Respective return pipes, one of which 46 is indicated in FIG. 2, lead from the respective spaces between adjacent spiral baffles to the interior of the shaft 48. Cooling water supplied to the inside of shaft 34 is directed into the spaces between adjacent baffles by supply pipes 36, 38, 40, 42 and 44. This water travels along the spiral paths between adjacent ribs to the return pipes 46 which direct the water into the interior of the shaft 48 from whence it returns to the supply.

I form the outer surface of shell 32 with a plurality of spaced grooves 50 running axially of the shell between points spaced slightly inwardly of the ends of the shell. While the grooves 50 are distributed around the entire periphery of the shell 32, for purposes of simplicity in FIG. 2 only the upper and lower grooves and four intermediate grooves are shown. Preferably, I connect the ends of the grooves 50 adjacent to the ends of shell 32 by respective annular grooves 49 and 51. The portions of the shell 32 which extend beyond the end plates 18 and 20 form respective lips 52 and 54 which receive stators indicated generally by the reference characters 56 and 58. These stators 56 and 58 have hubs which receive respective bushings 60 and 62 which support the shafts 34 and 48 so that the roll can rotate relative to the stators.

I form each of the stators 56 and 58 with a peripheral groove 64 located just within the lip 52 or 54 of the stator. I also drill a plurality of holes 66 in the bases of the grooves 50 at the locations of grooves 49 and 51 so as to afford communication between the stator grooves 64 and the longitudinal grooves or channels 50 in the outer surface of shell 32. Respective pipes 68 and 70 adjacent to the upper ends of the stators, as viewed in FIG. 2, connect the grooves 64 to a suitable source of reduced pressure.

I provide a pair of pins 72 and 74 disposed in suitable bores in the stators 56 and 58 to prevent the stators from rotating with the roll.

I assemble a thin skin 76 over the outer surface of the shell 32 so as to rotate with the roll 14. The skin 76 is provided with perforations over the portion of the roll between the dot dash lines in FIG. 2. While the entire surface of the skin is provided with perforations in this region, for simplicity the perforations have been shown in the drawings only in limited areas.

I provide my roll with means for limiting the vacuum to that segment of the roll which is contacted by the web 10. To this end I provide a pair of inserts 80 and 82 in the groove 64 at each side of the inlet pipe 68 or 70. Any suitable means, such for example as screws 84 and 86. may be used to hold these inserts in place. In the particular embodiment illustrated in the drawings, the inserts 82 and 84 limit the vacuum to an arc of about 70 degrees.

In operation of our cooled vacuum pull roll, the web 10 emerging from the station 12 extends over the surface of the roll 14 for approximately the 70 degree arc between the inserts 80 and 82. This region is connected to an area of reduced pressure through perforations 78, channels 50, holes 66, grooves 64 and pipes 68 and 70.

Cooling water supplied to the interior of shaft 34 flows outwardly through the pipes 36, 38, 40, 42 and 44 to the space between adjacent ribs 22, 24, 26, 28 and 30 down the spiral tracks between adjacent ribs through the outlet pipes 46 to the interior of the shaft 48 from which it returns to the supply. Owing to the thinness of the outer skin, the effective heat transfer results and the web is cooled.

It will be seen that I have accomplished the objects of my invention. I have provided a cooled vacuum pull roll which overcomes the difficulties of the prior art in handling webs carrying adhesive coatings and the like. My cooled vacuum roll effectively combines the functions of a vacuum pull roll and a cooling roll. It is extremely simple in construction and in operation for the results achieved thereby.

It will be understood that certain features and subcominations are of utility and may be employed without reference to other features and subcombinations. This is contemplated by and is within the scope of my claims. It is further obvious that various changes may be made in details within the scope of my claims without departing from the spirit of my invention. It is, therefore, to be understood that my invention is not to be limited to the specific details shown and described.

Having thus described my invention, what I claim is:

1. A pulling roll assembly for drawing a web out of a process station including in combination a rotor comprising an outer shell, a plurality of axially extending grooves in the outer surface of said shell, said grooves being separated by lands and extending between respective locations adjacent the ends of said shell, a skin supported by said lands, said skin having perforations registering with said shell grooves, said rotor having a recess at one of its ends, said recess extending axially inwardly beyond said location adjacent said end of said shell, a stator extending into said recess, said stator having a peripheral groove of limited circumferential extent at said location, means providing communication between said shell grooves and said stator groove at said location, means connecting said stator groove at reduced pressure and means for cooling said shell.

2. A pulling roll assembly as in claim 1 in which cooling means comprises a hollow shaft extending through said stator.

3. A pulling roll assembly as in claim 1 in which said shell is an outer shell, said means for cooling said outer shell comprising an inner shell, means forming a plurality of spiral passages extending axially of said rotor between said shells and means for flowing a cooling medium through said passages.

4. A pulling roll assembly as in claim 3 in which said stator is a first stator, said rotor having a second recess at the other end extending axially inwardly beyond said other location adjacent said other end of said shell, a second stator extending into said second recess, said second stator having a peripheral groove of said limited circumferential extent at said other location, means providing communication between said shell grooves and said second stator groove at said other location and means connecting said second stator groove to reduced pressure.

5. A pulling roll assembly as in claim 4 in which said means for flowing a cooling medium through said passages comprises respective hollow shafts extending through said stations and means connecting the interiors of said shafts to said passages.

6. A pulling roll assembly as in claim 4 including respective annular grooves in the outside surface of said shell at said locations.

7. A pulling roll for receiving a heated web around a portion of the roll periphery and for drawing said web out of a process station while cooling the web including in combination a generally cylindrical outer shell of thermally conductive material, a plurality of axially extending grooves spaced over the outer surface of said outer shell, a skin over the outer surface of said outer shell, said skin being provided with perforations communicating with said grooves, means connecting said grooves over a segment of said roll periphery limited to said portion to a region of reduced pressure to hold said web against said roll with a force sufficient to produce a pulling force upon rotation of the roll to draw said web out of said process station, a hollow outer shell disposed within said inner shell to form a space between said shells, means disposed between said shells forming a plurality of spiral passages in said space extending from one end of said roll to the other, respective hollow shafts at the ends of said roll, means forming a first plurality of conduits located at one end of said roll connecting the respective passages to the interior of one of said hollow shafts, means forming a second plurality of conduits located at the other end of said roll connecting the respective passages to the interior of the other of said hollow shafts and means for supplying coolant to one of said hollow shafts to cause coolant to flow through said conduits and through said passages and out through the other one of said hollow shafts to cool the web.

8. A pulling roll as in claim 7 in which said means for connecting said grooves to a region of reduced pressure is confined in a radial direction to a space less than the radius of said outer shell.

* * * * *

UNITED STATES PATENT AND TRADEMARK OFFICE

CERTIFICATE OF CORRECTION

PATENT NO. : 5,103,898

DATED : April 14, 1992

INVENTOR(S) : Leonard C. Krimsky

It is certified that error appears in the above-identified patent and that said Letters Patent is hereby corrected as shown below:

In the Claims:

Claim 7, col. 4, line 39, change "outer" to --inner--;

Claim 7, col. 4, line 40, change "inner" to --outer--.

Signed and Sealed this

Eighth Day of June, 1993

*Attest:*

Michael K. Kirk

MICHAEL K. KIRK

*Attesting Officer*

*Acting Commissioner of Patents and Trademarks*